US005273642A

United States Patent [19]

Crites et al.

[11] Patent Number: 5,273,642

[45] Date of Patent: Dec. 28, 1993

[54] APPARATUS AND METHOD FOR ELECTROPLATING WAFERS

[75] Inventors: James W. Crites; J. Meade Coulson, both of Roanoke, Va.

[73] Assignee: ITT Corporation, New York, N.Y.

[21] Appl. No.: 988,184

[22] Filed: Dec. 9, 1992

Related U.S. Application Data

[62] Division of Ser. No. 871,854, Apr. 21, 1992.

[51] Int. Cl.[5] ..... C25D 5/02

[52] U.S. Cl. ..... 205/118; 205/122

[58] Field of Search ..... 205/118, 122

[56] References Cited

U.S. PATENT DOCUMENTS 5,024,746 6/1991 Stierman ..... 204/297 W

*Primary Examiner*—T. M. Tufariello

*Attorney, Agent, or Firm*—Arthur L. Plevy; Patrick M. Hogan

[57] ABSTRACT

An apparatus and corresponding method for electroplating wafers includes supporting a plurality of wafers on a backing board in the electroplating tank such that one surface of each wafer is masked from the electrolytic reaction. A programmable controller is used to regulate the waveform, frequency and duration of current passing between each individual wafer and a corresponding anode electrode during the electroplating process. Voltage is monitored between the wafers and the anode electrodes to ensure a proper electrical connection is maintained with each individual wafer during the electroplating process.

8 Claims, 7 Drawing Sheets

APPARATUS AND METHOD FOR ELECTROPLATING WAFERS

This is a division of application Ser. No. 07/871,854, filed Apr. 21, 1992.

FIELD OF THE INVENTION

This invention relates to an apparatus and method for the electrodeposition of metal onto a wafer substrate, and more particularly to such apparatuses and methods that support the wafers in an electrolytic solution, monitor the electrical contact with the wafers during electroplating and regulate the waveform, frequency and duration of the electric current used to create the electrolytic reaction.

BACKGROUND OF THE INVENTION

Wafers, in the microelectronic industry, are often coated with varying metals to facilitate such things as component interconnection with the wafer. Coating wafers with different metals is often accomplished with such deposition techniques as electron beam evaporation or sputter deposition. However, for depositing relatively thick films onto wafers, electroplating has become the most commonly used technology. When plating wafers, often the metal used in the plating is a precious metal such as gold or platinum. Obviously, with precious metal platings it is desirable to reduce the amount of plating material lot to waste. Both electron beam evaporation and sputter deposition create more waste when depositing thick films than does electroplating. Consequently, when electroplating can be used, it is the most cost effective method of metal film deposition.

When used on wafers, electroplating is not without disadvantages. Often, only one side of a wafer needs to be coated. With other techniques, such as electron beam evaporation and sputter deposition, a one-sided coating is easy to obtain. However, with electroplating all the surfaces that are submersed into the electroplating solution may incur some degree of plating. To limit metal deposition on unwanted areas of wafers, wafers must be masked with a dielectric material such as a mylar film. The application and removal of masking material, before and after electroplating, reduces the efficiency of the overall process.

Another disadvantage of electroplating wafers is the turbulent environment of an electroplating tank. Electroplating solution is often circulated during the plating process to assure uniformity in the deposited materials. Wafers are planar and are also often brittle. The planar shape of the wafer is easily influenced by the flow of the electroplating solution. Consequently, wafers may break or crack during the electroplating process. Some cracks may be obvious and the wafer easily discarded, however some cracks may be microscopic and may cause failure of the wafer only after an extended period of time or repeated thermocycling.

Yet another disadvantage of electroplating wafers is controlling the rate of metal deposition. The deposition rate of electroplating depends on many factors such as the density of the metal ions in the electroplating fluid, the electrical coupling of the wafer to a cathode source, the frequency of the current passing through the wafer, and the waveform of the current. It is only by controlling these factors that an accurate plating thickness can be manufactured without the need for repeated measurements of the plating thickness during the electroplating process.

It is therefore a primary objective of the present invention to set forth an apparatus and method for electroplating wafers wherein only one side of a wafer is electroplated without the need of masking film, the wafer is not subject to fluid turbulence during the electroplating procedure and the operating parameters of the electroplating process can be maintained at predetermined values.

SUMMARY OF THE INVENTION

The present invention provides an apparatus and corresponding method for electroplating metal onto wafers. More specifically, the present invention provides a plating tank wherein a plurality of wafers can be supported on backing boards that are adjustably positionable across from a corresponding plurality of anode electrodes. The backing boards provide a solid surface on which the wafers can lay, thus preventing the wafers from fracturing due to agitation of electrolytic solution. The backing boards also shield one surface of the wafers from the electrolytic solution, consequently removing the need for masking one surface of each wafer prior to the electroplating process.

The wafers are held onto the backing boards by an eagle beak shape pinch probe that includes a sharpened edge. The probe contacts the wafer, helping to hold it in place, while the sharpened edge cuts through any dielectric material deposited on the wafer, contacting the underlying conductive material. The pinch probe thus serves as the medium through which the wafer is coupled to a cathode source and a voltmeter.

The anode electrodes, positioned across from each wafer, are coupled to variable current sources that can be varied in both waveform and frequency. The anodes are similarly coupled to a voltmeter; consequently the voltage between a single anode electrode and a single wafer can be monitored. During electroplating the waveform and frequency of current between each individual wafer and anode electrode can be controlled by a programmable microprocessor. The microprocessor uses optimized operating parameters for the electroplating process in a given application, thus ensuring the desired plating results. The microprocessor could also monitor other parameters such as the level of the electrolytic solution and its temperature, as well as the conductive contact between the wafers and the pinch probe. If a deficiency in a physical parameters effecting electroplating efficiency is detected by the microprocessor, the electroplating of the wafers effected may be automatically stopped to reduce waste.

BRIEF DESCRIPTION OF THE FIGURES

For a better understanding of the present invention, reference is made to the following description of an exemplary embodiment thereof, considered in conjunction with the accompanying drawings, in which.

DETAILED DESCRIPTION OF THE DRAWINGS

Electroplating metal onto items such as wafers requires that the wafers be placed into an electrolyte containing ions of the metal to be deposited. The wafers are coupled to sources of negative electric potential, thus causing the wafers to act as cathodes. Electric current is passed through the electrolyte from an appropriate anode and the ionized metal is deposited on the wafer by an oxidation-reduction reaction.

Figure 1:
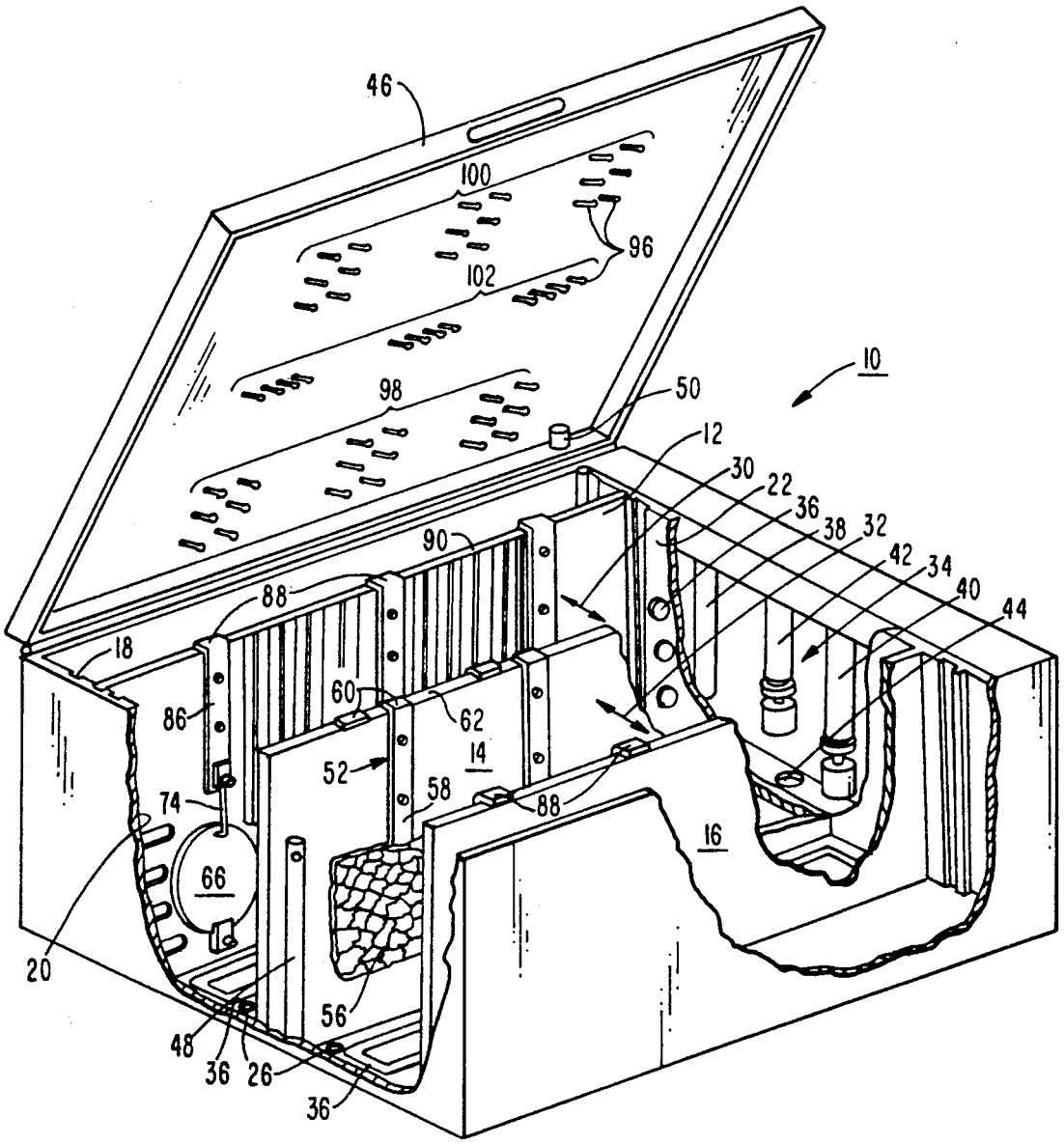
FIG. 1 is a perspective view of an electroplating tank constructed in accordance with one exemplary embodiment of the present invention, the electroplating tank being shown in a partially fragmented fashion to facilitate consideration and discussion.

Referring to FIG. 1 there is shown one embodiment of the electroplating tank 10 of the present invention. Although the electroplating tank 10 can be of any shape or size, the preferred embodiment is a rectangular tank having the capacity to hold approximately ten liters of electrolytic solution (not shown) at a predetermined level. The relatively small tank volume provides only moderate costs in obtaining the desired electrolytic solution and allows for practical decisions regarding chemical additions and solution replacement.

Three backing boards 12, 14, 16 are positioned in parallel in the tank 10. The vertical edges of the backing boards 12, 14, 16 are fitted into slotted grooves 18 that are formed in a side tank wall 20 and a support wall 22. The backing boards 12, 14, 16 are not fastened to the tank 10 and can be removed from the tank 10 by lifting the backing boards 12, 14, 16 out of the tank 10 and out of the support of the slotted grooves 18. It should also be noted that a plurality of slotted grooves 18 are formed on both the side tank wall 20 an the support wall 22. The plurality of slotted grooves 18 allows the backing boards 12, 16 to be placed at different locations within the tank 10. Consequently, the distance between the backing boards 12, 14, 16 can be varied, as can the volume of electrolytic solution contained between opposing backing boards. The positioning of the backing boards 12, 14, 16 in the tank 10 divides the tank 10 into two plating chambers 30, 32; one plating chamber formed on either side of the center backing board 14.

Electrolytic solution is introduced into each plating chamber 30, 32 through inlet orifices 26. Heater coils 36 serpentine across the bottom of the plating tank 10. The heater coils 36 electrolytic solution to a predetermined temperature that is optimized for the current electroplating process. A fluid monitoring compartment 34 is formed in the tank 10 adjacent to the plating chambers 30, 32. The fluid monitoring compartment 34 is separated from the plating chambers 30, 32 by the support wall 22. As electrolytic solution fills each plating chamber 30, 32 the electrolytic solution flows into the fluid monitoring compartment 34 through apertures 36 formed in the support wall 22. A resistance-temperature detector (RTD) device 38 is present in the fluid monitoring compartment 34 and extends into the electrolytic solution to monitor the temperature of the electrolytic solution. It should be understood that although a RTD probe 38 is shown, any temperature sensing device can be used including the use of thermocouple technologies. The use of both an RTD probe 38 and a heater coil thermocouple may be used simultaneously, as a system safeguard, to assure the heating coils 36 do not overheat the electrolytic solution.

Also present in the fluid monitoring compartment 34 are two floats for monitoring the level of electrolytic solution in the plating chambers 30, 32. A low level float 40 monitors whether the electrolytic solution has dropped to a level below a predetermined minimal value. A high level float 42 monitors whether the electrolytic solution has risen above a predetermined maximum value. A drain orifice 44 is positioned on the bottom of the fluid monitoring compartment 34. The drain orifice 44 removes electrolytic fluid from the plating chambers 30, 32, allowing the electrolytic fluid to be filtered and recirculated into the plating chambers 30, 32, as will be later detailed.

The tank 10 is covered by a lid 46. A standpipe 48 extends up from the bottom of the tank 10 to a level above the maximum depth of electrolytic solution. The standpipe 48 allows an inert atmosphere, such as nitrogen gas, to be introduced into the tank 10 during the electroplating procedure. The inert atmosphere prevents the electrolytic solution from reacting with ambient air. A vent pipe 50 extends into the tank 10 to allow for the evacuation of air and fumes from the tank 10 when the inert atmosphere is introduced.

The center anode backing board 14, that divides the first and second plating chambers 30, 32, supports the anode electrodes 52 used during the electroplating procedure. The anode electrodes 52 include a conductive wire mesh 56 supported onto the anode backing board 14 with a conductive L-shaped bracket 58. The foot 60 of the L-shaped bracket 58 hooks across to top edge 62 of the anode backing board 14. Consequently, the foot 60 of each L-shaped bracket 58 rests upon, and extends above, the anode backing board top edge 62. Six anode electrodes 52 are supported by the anode backing board 14. Three anode electrodes 52 on one side facing the first plating chamber 30, and three positioned on the opposite side facing the second plating chamber 32.

Figure 2:
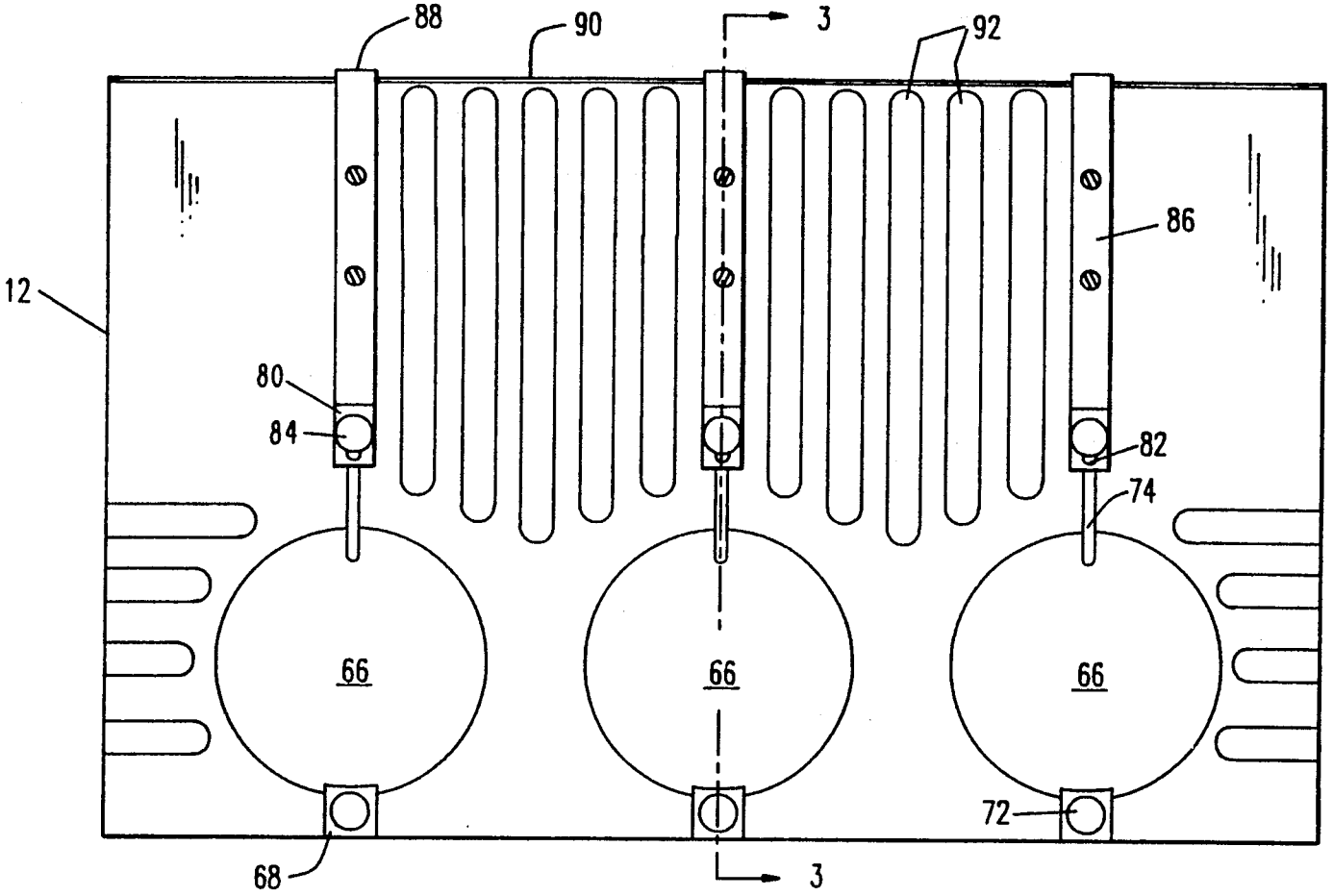
FIG. 2 is a front view of one exemplary embodiment of the backing board on which wafers are mounted within the electroplating tank.
Figure 3:
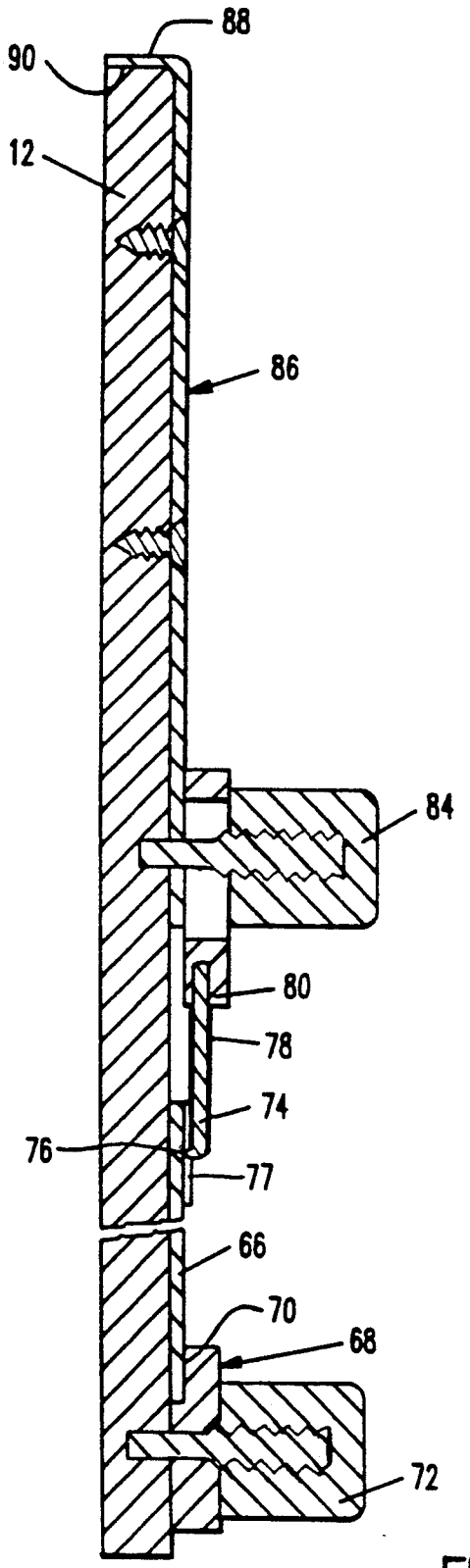
FIG. 3 is a side cross sectional view of the backing board shown in FIG. 2 taken along section line 2—2.

The wafer backing boards 12, 16, on either side of the center anode backing board 14, support wafers 66 in such a manner so that the wafers 66 act as cathodes during the electroplating process. Referring to FIGS. 2-3 in conjunction with FIG. 1, the construction of the wafer backing boards 12, 16 can be detailed. As is illustrated, a wafer 66 is held onto a backing board at two points. Both points of retainment falling within what is typically called the "dropout" region; the dropout region being the part of the wafer 66 that is not used and is discarded as waste. The area of the wafer backing boards 12, 16 on which the wafers 66 lay is uniformly smooth. The wafers 66, when held against the wafer backing boards 12, 16, form a seal against the wafer backing boards 12, 16 that is practically fluid impermeable As such, substantially no electrolytic fluid flows between the wafers 66 and the wafer backing boards 12, 16 during the electroplating process and the area of the wafers 66 in contact with the wafer backing boards 12, 16 is substantially shielded from the electroplating process The positioning of the wafers 66 onto the wafer backing boards 12, 16 also eliminates any effect the agitation of the electrolytic solution may have had on the integrity of the wafers 66. The wafers 66 are anchored in place and, as such, are unaffected by the flow of electrolytic solution.

The wafers 66 are held against the smooth areas of the wafer backing boards 12, 16 at one point by a vice bracket 68. The vice bracket 68 having a face 70 that is formed to correspond to the shape of the wafer 66. The face 70 is tightened against the wafer 66 via thumb screw 72. The wafer 66 is also held against the wafer backing board 12, 14 by an eagle beak shaped pinch probe 74, having a sharpened knife edge 76. The knife edge 76 is pressed against the wafer 66 such that the knife edge 76 would cut through any masking layer 77 or other non-conductive films that may be present on the surface of the wafer 66. The cutting of the knife edge 76 of the pinch probe 74 through the masking layer 77 ensures a good electrical connection between the wafer 66 and the pinch probe 74. The pinch probe 74 is formed from a conductive material and is coated on all surfaces, except the knife edge 76, by a non-conductive material 78 that prevents the pinch probe 74 from reacting with any electrolytic solution. The pinch probe 74 is supported by a conductive base 80 through which a slot 82 is formed. A thumbscrew 84 passes through the slot 82; thus allowing the pinch probe 74 to be adjusted both in its contact with the wafer 66 and the force at which the knife edge 76 engages the wafer 66.

The thumbscrews 84 that join the pinch probe bases 80 to the wafer backing boards 12, 16, also connect the pinch probe bases 80 to a corresponding L-shaped bracket 86. The foot 88 of each L-shaped bracket 86 hooks across the top edge 90 of the wafer backing boards 12, 16 on which the bracket 86 is attached. Consequently, the foot 88 of each L-shaped bracket 86 rests upon, and extends above, the top edges 90 of the wafer backing boards 12, 16. The L-shaped bracket 86, pinch probe base 80 and pinch probe 74 are all fabricated from conductive materials. As such, when the pinch probe 74 is contacting the wafer 66 there exists a direct electrical coupling between the foot 88 of the L-shaped bracket 86 and the wafer 66.

Each of the wafer backing boards 12, 16 also has a plurality of slot reliefs 92 formed on the surface of the backing boards 12, 16 at points adjacent to the wafers 66. Wafers 66 are very thin, consequently they are difficult to remove from flat surfaces such as the wafer backing boards 12, 16. Additionally, surface adhesion resulting from fluid between the wafers 66 and the wafer backing boards 12, 16 could further complicate the easy removal of the wafers 66. The slotted reliefs 92 allow the surface adhesion below the wafer 66 to be disrupted and permits the wafers 66 to be gripped by tweezers or the like. To remove a wafer 66 from a wafer backing board 12, 16, the wafer is slid over the slotted reliefs 92. The adhesive force that exists below the wafers 66 is greatly reduced and the edges of the wafer 66 are easily engaged.

Each wafer backing board 12, 16 holds the wafers 66 such that the wafers 66 face the anode electrodes 52 positioned on the middle anode backing board 14. The number and position of wafers 66 held by the wafer backing boards 12, 16 correspond exactly with the position and number of anode electrodes 52 facing each wafer backing board 12, 16. When in the tank 10, each wafer 66 is aligned with a corresponding anode electrode 52 across either plating chamber 30, 32. The position of one wafer 66 across from one anode electrode 52, in either plating chamber 30, 32 is considered one "plating cell" for the purposes of this description. In the embodiment shown in FIG. 1, there are two plating chambers 30, 32. Each plating chamber 30, 32 includes three wafers 66 aligned opposite three anode electrodes 52; as such the shown embodiment incudes six plating cells, three plating cells in each plating chamber 30, 32.

Referring back to FIG. 1, it can be seen that a plurality of pin connectors 96 extend downwardly from the tank lid 46. The pin connectors 96 are positioned so that two pin connectors will contact each and every foot 88 of the L-shaped brackets 86 on the wafer backing boards 12, 16 and each foot 60 of the L-shaped brackets 58 on the anode backing board 14. The pin connectors 96 positioned in the lowest pin set 98 on the tank lid 46, correspond in position to the L-shaped brackets 86 on the first wafer backing board 12. Since the first wafer backing board 12 can be varied in position in the tank 10, a plurality of pin connectors 96 are positioned along different parallel lines to correspond to the various possible positions of the wafer backing board 12. Similarly, a plurality of pin connectors 96 are positioned in the highest pin set 100, so as to contact the second wafer backing board 16 regardless of its positioning in the tank 10. In the embodiment shown, both wafer backing boards 12, 16 can be positioned in one of three locations in the tank 10. Accordingly, both the top set 100 and the bottom set 98 of pin connectors 96 are formed from three parallel lines of pin connectors 96. Each parallel line corresponds in position to a possible location of either wafer backing board 12, 16.

The center anode backing board 14 supports the anode electrodes 52. In the embodiment illustrated, the anode backing board 14 is fixed in position in the tank 10 and cannot be altered. When the tank lid 48 is closed, the center set 102 of pin connectors 96 contact the foot 60 of each L-shaped bracket 58 on the anode backing board 14. Since the anode backing board 14 is set into one position, the center set 102 of pin connectors 96 on the tank lid 48 need only be aligned in one parallel row. The anode backing board 14 supports six anodes 52, as such, the center set of pin connectors 96 includes twelve pin connectors 96, two pin connectors 96 for each anode 52.

As has been described, two pin connectors 96 contact each wafer support bracket 86 and each anode support bracket 58 when the tank lid 46 is closed. The pin connectors 96 themselves are spring loaded so as to be spring biased against the wafer support brackets 86 and the anode support brackets 58 when the tank lid 46 is closed. The tank lid 46 may be weighted, or include other means that increase the force of the tank lid 46 against the tank 10, when the tank lid 46 is closed. The addition of weights to the tank lid 46 will help to insure that the pin connectors 96 make a proper electrically conductive connection against the wafer support brackets 86 and anode support brackets 58. Spring loaded pin connectors 96 of the present invention are well known items and may include sharpened contact heads or other well known features common to such pin connectors.

Figure 4:
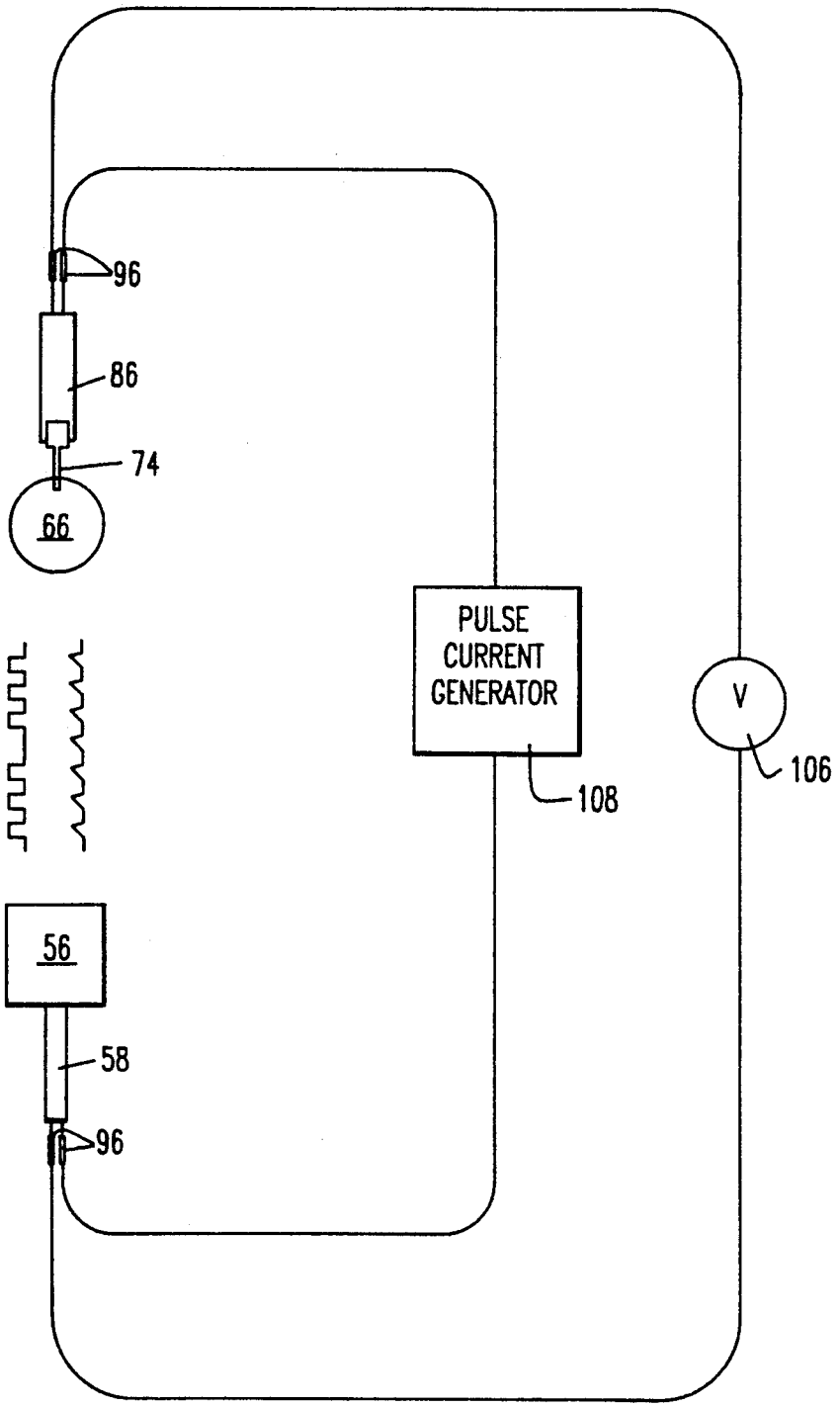
FIG. 4 is a schematic illustration of one exemplary embodiment of the electrical coupling between the wafer and an anode electrode during the electroplating procedure.

Referring to FIG. 4 there is shown a schematic illustration of one plating cell of the present invention during the electroplating process. As can be seen, a wafer 66 is conductively coupled to a pinching probe 74 and a support bracket 86. Opposite the wafer 66 is positioned an anode electrode 56 which is similarly coupled to a support bracket 58. As has been previously described, when the tank lid is closed onto the tank, two pin connectors 96 contact both the wafer support bracket 86 and the anode support bracket 58. Consequently, both the anode electrode 56 and the wafer 66 are conductively coupled to two pin connectors 96. One of the pin connectors 96 that is coupled to the wafer 66 and the anode electrode 56, leads to a voltmeter 106 or other similar voltage monitoring device. The voltmeter 106 measures the flow of electricity from the wafer 66 to the anode electrode 56 through the electrolytic solution. If the wafer 66 is not properly coupled to the pinching probe 74, the flow of electricity will be effected. Consequently, the voltmeter 106 monitors voltage in real time allowing an operator to ascertain whether a proper electrical contact is being maintained with the wafer 66 during the electroplating procedure. If the electrical contact with the wafer 66 is not adequate, the voltmeter 106 could be set to automatically sound an alarm and/or stop the plating procedure until the wafer 66 connection is corrected.

The second set of pin connectors 96, that are coupled to both the wafer 66 and the anode electrode 56, are attached to a current source such as a pulse current generator 108. Current is produced in the current generator 108 sufficient to establish the electrolytic reaction between the wafer 66 and the electrolytic solution in which the wafer 66 is held. Most electroplating is performed with direct current flowing between the anode and the cathode. However, with the use of a pulse current generator 108 complex waveforms can be created. The present invention current generator 108 is preferably capable of creating a variety of waveform shapes with current frequencies ranging from 1 Hz to 500 Hz. The waveform shapes may vary during a given plating application and may have a varying driving current level to compensate for changes in wafer plating area that may occur as plating progresses. Different plating applications, involving varying wafer materials and differing electrolytic solutions, may include different frequencies and waveforms in the current to optimize the electroplating process. The specific waveforms and frequencies for any given application may be experimentally and/or mathematically determined. Once determined the plating current parameters may be stored in the memory of a system controller (as will be later described), and may be recalled and used to control the pulse current generator as needed.

Figure 5:
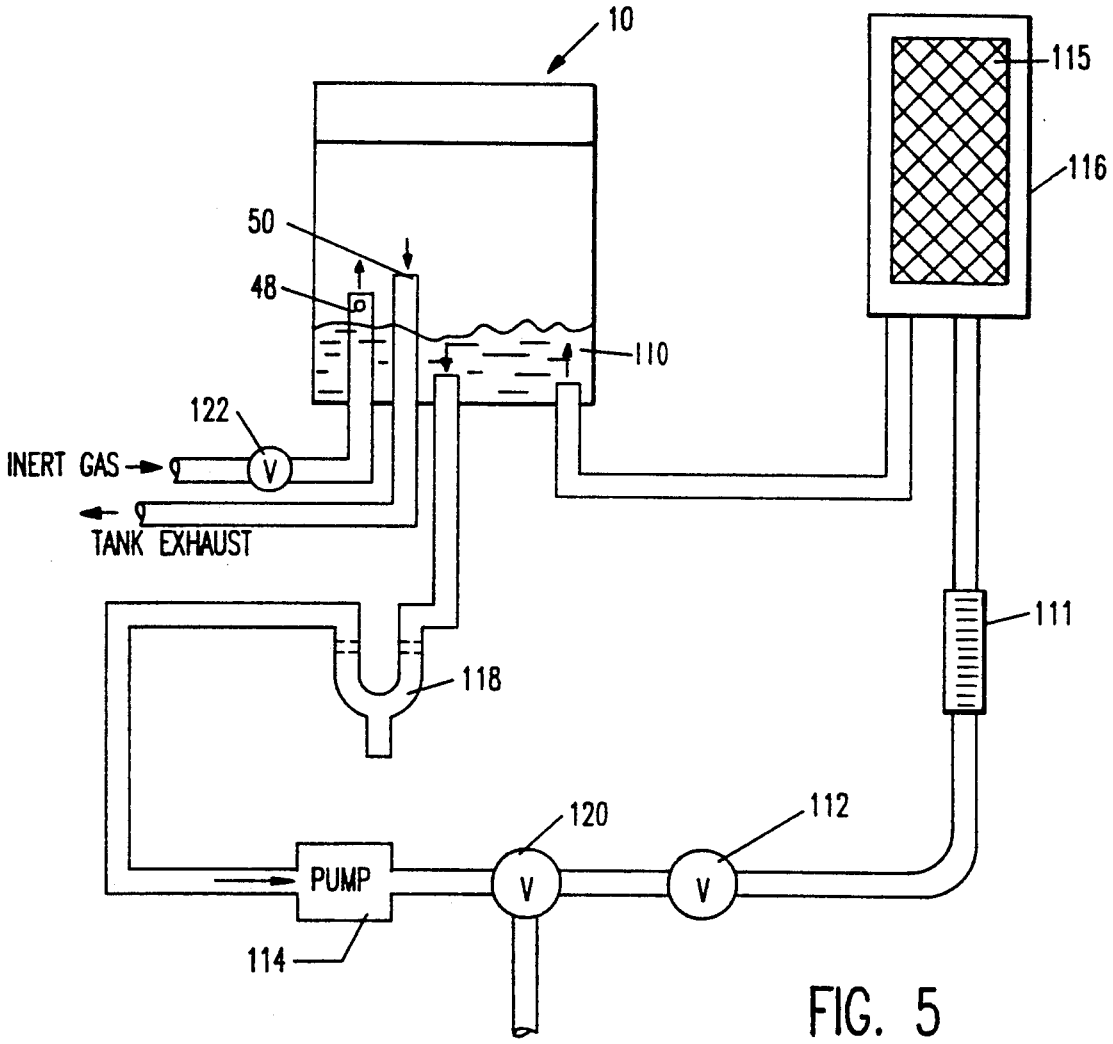
FIG. 5 is a schematic illustration of one exemplary embodiment of the hydraulic and pneumatic workings of the present invention.

Referring to FIG. 5, a general schematic illustration is shown for the fluids and fluid controls of the present invention system. As has been previously described, the tank 10 is filled to a predetermined level with an electrolytic solution 110. The electrolytic solution 110 is introduced into the tank 10, by manually pouring the solution into the tank 10. Once the tank 10 is filled to a predetermined level with electrolytic solution 110, the electrolytic solution 110 is circulated. A pump 114 draws electrolytic solution 110 from the tank 10 through the drain orifice 44, and a debris trap 118. The electrolytic solution 110 is then reintroduced into the tank 10 through throttle valve 112, flow gauge 111, filter 116, and into input orifice 26. The pump 114 used to circulate the electrolytic solution 110 is a magnetically coupled impeller drive pump having a flow rate adjusted by throttle valve 112 of between 0 gpm and 5 gpm as adjusted by the throttle valve 112. To help protect the pump 114 from debris in the electrolytic solution 110, the solution is drawn through a debris trap 118, prior to entering the pump 114. Additionally, to help remove fine debris particles from the electrolytic solution 110, the filter 110 contains a cartridge filtering element 115. Typically, the cartridge filtering element 115 is replaceable. As such, the filter 116 is positioned in an easily accessible position above the level of the electrolytic solution 110 in the tank 10. As such, the cartridge filtering element 115 can be easily changed without loss of electrolytic solution 110 to the system.

A drain valve 120 may be positioned in the pump system to provide a means discharging electrolytic solution 110 from the tank 10. Obviously, since electrolytic solution 110 is circulated through the tank 10, and associated plumbing, by the pump 114, the plumbing, pump 114, filter 116 and debris trap 118 are all constructed so as not to react with the electrolytic solution 110. Hydraulic components and component materials that do not react to electrolytic solutions are well known in the art of industrial electroplating equipment.

During the electroplating procedure the tank 10 is filled with electrolytic solution 110 to a predetermined level. Extending above the electrolytic solution 110 in the tank 10 is a standpipe 48. The standpipe 48 is attached to a source of inert gas(es) such as nitrogen, the passage of the gas through the standpipe 48 being regulated by a control valve 122. A vent pipe 50 is positioned at a high level in the tank 10. The vent pipe 50 allows any air or fumes trapped in the tank 10 to be vented to the exhaust when displaced by the introduction of the inert atmosphere through the standpipe 48. By introducing an inert atmosphere above the electrolytic solution 110, unwanted chemical reactions between the electrolytic solution 110 and ambient air are prevented.

Figure 6:
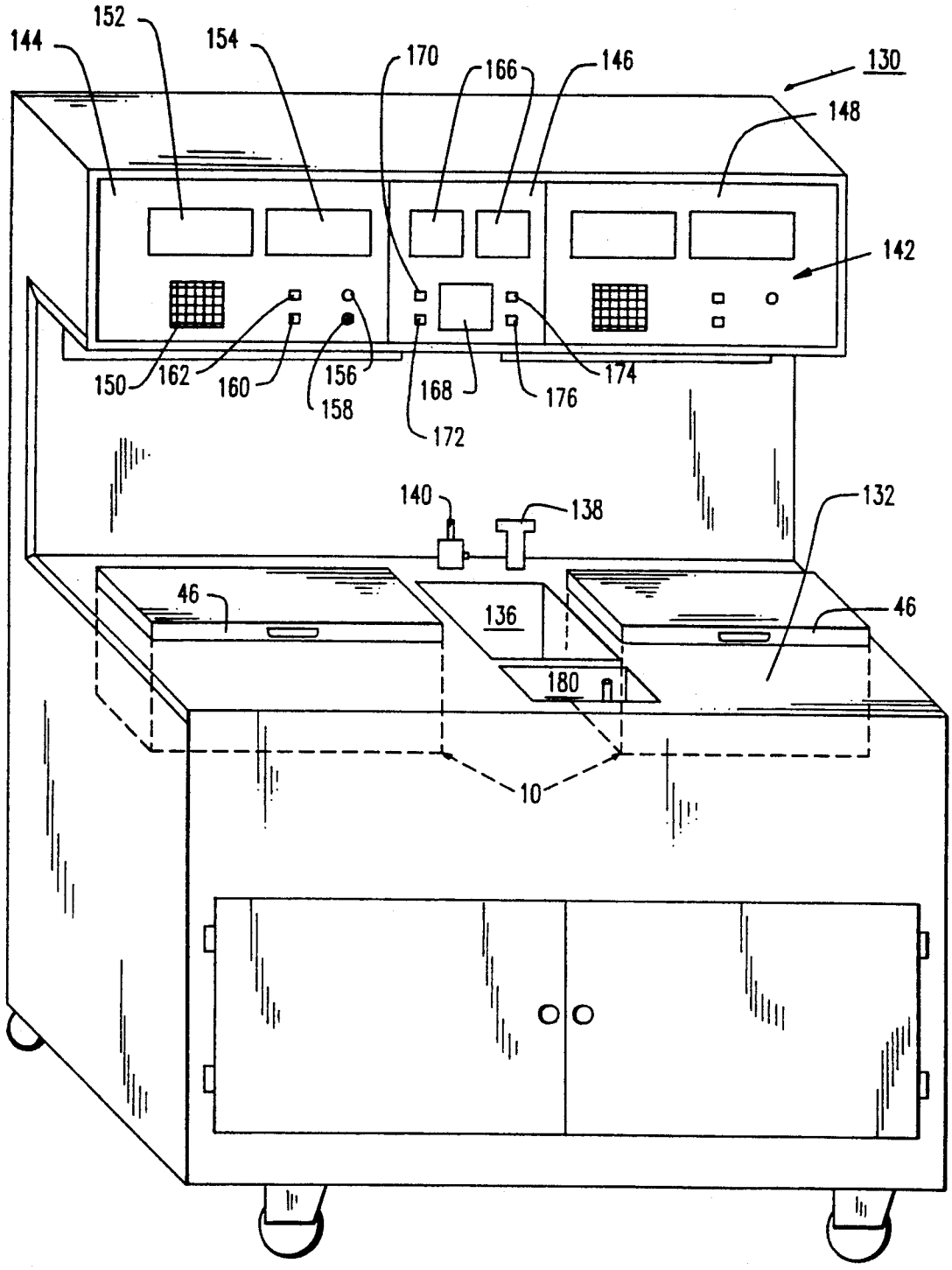
FIG. 6 is a perspective view of one exemplary embodiment of an electroplating apparatus containing two electroplating tanks as illustrated in FIG. 1.

In FIG. 6 there is shown a preferred embodiment of an electroplating apparatus 130 including two plating tanks 10 as have been previously described. Referring to FIG. 6 in conjunction with FIG. 1, the interconnection of the plating tank 10 to the overall apparatus can be detailed. Each plating tank 10 is positioned as part of a platform surface 132, such that the tank lids 46 of each tank 10 extends above the platform surface 132 and is accessible by an operator. The use of two plating tanks 10 in the same electroplating apparatus 130 allows for the use of different bath chemistries and/or plating parameters to be used simultaneously and could serve as backup systems to each other if needed.

Between the plating tanks 10 is positioned a rinse sink 136 that can be filled with electrolytic solution. Above the rinse sink 136 is positioned a rinse hose 138 for selectively spraying rinse solution (typically deionized water) and a gas hose 140 for selectively spraying an inert gas such as nitrogen The electroplating apparatus shown has a control panel 142 divided into three subpanels 144, 146, 148. The two end subpanels 144, 148 are identical and are used to control the plating operations of the two plating tanks 10, respectively. On each end subpanel 144, 148 are positioned a keypad 150, a program display 152, a run display 154, an electrolytic solution level indicator light 156, an alarm buzzer 158 and push buttons 160, 162 for activating the pump and heater coils.

The center subpanel 146 includes two temperature controllers 166 for monitoring and controlling the temperature of the electrolytic solution in each tank 10. Also included on the center subpanel 146 is a timer 168, push buttons 170, 172 for opening and closing the drain of the rinse sink 180 and for turning on or off sink valve. Push buttons 174, 176 for turning on and off the power to the electroplating apparatus 130 are also located on subpanel 146. The timer 168 can be programmed to power up or down the heater coils 36 and circulating pump 114 while the electroplating apparatus is unattended. The timer 168 may also be used to enable the unattended preheating of the electrolytic solution in the plating tanks 10 prior to the initiation of the electroplating process.

Figure 7:
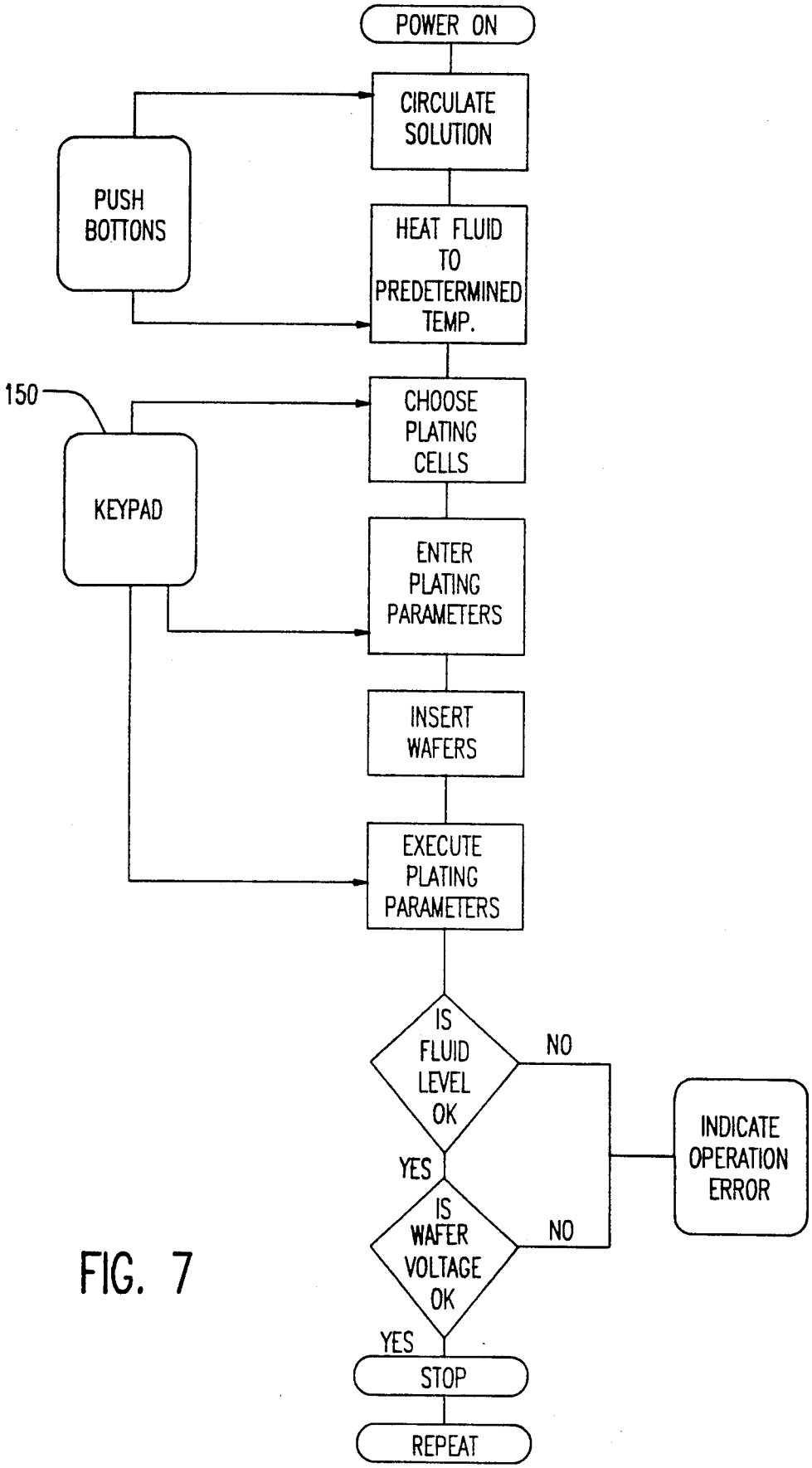
FIG. 7 is a flow diagram illustrating the general control program for operating one exemplary embodiment of the present invention electroplating apparatus.

In FIG. 7 there is shown a block diagram illustrating the operation of the present invention electroplating apparatus. Referring to FIGS. 1, 4–5 and 6 for component identification, in conjunction with FIG. 7, the operation of the present invention can be expressed.

Power is supplied to the plating system by depressing the power-on button 174 on the control panel 142. Once enabled, electrolytic solution containing ions of the metal to be deposited is introduced into the plating tanks 10. The high float switch 42 in the plating tank 10 monitors when the electrolytic solution has reached its predetermined operating level. The circulation pump 114 is activated by engaging the pump-on push button 160; thus the electrolytic solution begins to be circulated and filtered.

The electrolytic solution is heated by depressing the heat-on push button 162 which activates the heating coils 36 located on the bottom of the plating tank 10. The heating coils 36 are controlled by the temperature controllers 166 and heat the electrolytic solution to a preprogrammed temperature. The actual temperature of the electrolytic solution is relayed to the temperature controllers 166 via the resistance-temperature detector 38. The electrolytic solution is allowed to reach equilibrium at the preset temperature.

The next operation is to program the microprocessor system controller for a desired plating run. Using the keypad 150 the system controller may be accessed. The keypad 150 lets an operator either recall previous stored operating parameters from a memory source or enter new operating parameters. The exemplary embodiment of the present invention has six plating cells in each plating tank 10. However, during use it may not always be desirable to plate six wafers simultaneously As such, the current system controller allows each of the six plating cells in each plating tank 10 to be operated individually or not at all. Utilizing the keypad 150 a control menu can be recalled onto the run display 154. A sample of such a control menu is as follows:

| *PLATING* | -c1- | -c2- | -c3- | -c4- | -c5- | -c6- |
|---|---|---|---|---|---|---|
| DATA SET | >232 | 232 | OFF | OFF | 232 | 232 |
| STATUS | STBY | STBY | OFF | OFF | ON | ON |
| MILLIVOLTS | ___ | ___ | ___ | ___ | 496 | 498 |
| MILLIAMPS | 48 | 48 | ___ | ___ | 48 | 48 |
| TIME | 2000 | 2000 | ___ | ___ | 1731 | 1731 |

Utilizing the keypad 150 the appropriate data can be entered into the control menu. In the example above, it can be seen that plating cells c3 and c4 are not holding wafers and are turned off. Plating cells c5 and c6 are turned on and are running and plating cells c1 and c2 are turned on, but are not yet running. In the above shown control menu, the row marked "*PLATING*" indicates the plating cells The row marked "DATA SET" shows mask set numbers that correspond to operational parameters stored in memory. The row marked "STATUS" indicates to the operator if a plating cell is being used or is turned on or off. The row marked "MILLIVOLTS" indicates the voltage passing between the wafer and anode during plating and indicates to an operator whether or not a wafer is properly attached to a pinch probe. The rows for "MILLIAMP" and "TIME" refer to the current and duration of the plating process and will be discussed in accordance with programming new operational parameters.

To create new operational parameters for direct current (DC) plating, an operator can utilize the keypad 150 to recall the following program menu.

DC PLATING

| | | | | | |
|---|---|---|---|---|---|
| DATA SET | ___ | | | TOTAL TIME | ___ |
| mAMPS | >___ | mAMPS | ___ | mAMPS | ___ |
| TIME | ___ | TIME | ___ | TIME | ___ |
| RAMP | ___ | RAMP | ___ | | |

Time = mmss, Ramps in seconds (ssss)

In the first column a value for current is entered in milliamps. A second value for time is entered in minutes and seconds (e.g. 2230 is 22 min. 30 sec.). The last value in the column is a ramp time to the next current setting, which begins column two. The total time required for the run is automatically calculated and displayed in the space indicated. Additionally the data set can be assigned a mask set number in the corresponding space provided.

If an operator were creating a new mask set for a pulse plating operation the following program menu can be recalled:

PULSE PLATING

| | | | |
|---|---|---|---|
| DATA SET | ___ | TOTAL TIME | 1500 |
| OFF CURRENT | >___0 | ON CURRENT | __100 |
| OFF TIME | ___2 | ON TIME | ___2 |
| RISE TIME | ___0 | DECAY TIME | ___0 |

TOTAL TIME = MMSS. CURRENTS IN MILLIAMPS
OFF , RINSE, ON & DECAY TIMES IN MILLISECS

As with other menus, data is entered on the appropriate field as the cursor steps through the screen. The values requested set up a series of pulses with the following characteristics:

Off Current—The initial current or base current: usually zero but may be set to other positive value.

Off Time—The time period, in milliseconds, between "on" pulses.

Rise Time—The time allowed for the transition from the first current setting to the second.

On Current—Higher current which is the upper, or peak, current.

On Time—The time period, in milliseconds, during which high current is maintained.

Decay Time—The time allowed for the transition back to the Off Current.

The values shown in the sample menu above give a square wave with a frequency of 250 Hz and a duty cycle of 50%. Total plating time for this example is set by the operator at 15 minutes.

After the appropriate plating parameters are programmed into the systems controller, the wafers 66 are loaded onto the appropriate positions on the wafer backing boards 12, 14. First the wafer backing boards 12, 14 are removed from the plating tank 10 and dipped into the rinse sink 136. The wafers 66 are then positioned between the vice bracket 68 and piercing probe 74 as has been previously described. The wafer backing boards 12, 16 with wafers 66 are again dipped in the rinse sink 136 or rinsed with sprayer 138 to remove impurities and the wafer backing boards 12, 16 are placed in the plating tank 10.

The tank lid 46 is closed over the plating tank 10 and the air in the plating tank 10 is displaced with an inert atmosphere, such as nitrogen. The plating operating parameters are executed by pressing the appropriate key on the keypad 150. Once the plating process has begun, the systems controller monitors the voltage passing between the wafers 66 and the anode electrodes 56 and the temperature of the electrolytic solution. If the voltage between wafer 66 and anode 56 rises above a predetermined maximum the alarm buzzer 158 could sound and the plating procedure on that particular plating cell may be stopped. As has been discussed, a high voltage between anode 56 and wafer 66 would be caused by a poor connection between the piercing probe 74 holding the wafer 66 in place. If the electrolytic solution sinks below a predetermined minimum value, a signal is produced by the fill level float 42. Such a signal could sound the alarm buzzer 158 and plating would stop in all plating cells.

When the electroplating process is completed, the wafer backing boards 12, 16 are removed from the plating tank and rinsed. The wafers 66 are then removed and the process repeated.

It will be understood that the embodiment described herein is merely exemplary and that a person skilled in the art may make variations and modifications without departing from the spirit and the scope of the invention. More particularly, many components of the exemplary embodiment have well known mechanical equivalents. All such variations and modifications are intended to be included within the scope of the invention as defined in the appended claims.

What is claimed is:

1. A method for electroplating a layer of metal onto a wafer or the like, comprising the steps of:

supporting said wafer in an electrolytic solution;

producing an electrolytic reaction in said solution by passing current between said wafer and an anode electrode; and monitoring the voltage passing between said wafer and said anode electrode for determining whether a sufficient electrical contact is being maintained to said wafer during the electroplating process.

2. The method according to claim 1 wherein said step of producing an electrolytic reaction includes passing an electric current with a variably controlled waveform, frequency and duration, between said wafer and said anode electrode.

3. The method according to claim 2 wherein the waveform, frequency and duration of said current is controlled by a programmable control means.

4. The method according to claim 2 wherein said electric current has a pulsed waveform and a frequency of between 1 Hz and 500 Hz.

5. The method according to claim 2 wherein said electric current is a direct current having a stepped waveform.

6. The method according to claim 2 further including the step of displacing ambient air above said electrolytic solution with an inert atmosphere prior to said step of producing an electrolytic reaction.

7. The method according to claim 2 wherein said step of supporting said wafer includes attaching said wafer to a backing board so that the surface of said wafer that contacts said backing board is substantially masked from said electrolytic solution.

8. The method according to claim 7 further including the step of piercing any nonconductive layer that may exist on said wafer with a conductive probe that is coupled to a cathode electrode, thus coupling said wafer to said cathode electrode.

* * * * *